US006172293B1

(12) United States Patent
Anderson

(10) Patent No.: US 6,172,293 B1
(45) **Date of Patent: *Jan. 9, 2001**

(54) GRAND PIANO SECTIONAL CLOTH COVER

(76) Inventor: Kristina I. Anderson, 2245 Hamline Ave. North, Roseville, MN (US) 55113

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/044,432

(22) Filed: Mar. 19, 1998

(51) Int. Cl.[7] ..... G10C 3/02; G10G 7/00
(52) U.S. Cl. ..... 84/453; 84/183
(58) Field of Search ..... 84/80–82, 183, 84/453

(56) References Cited

U.S. PATENT DOCUMENTS

Re. 10,450 * 2/1884 Kraemer .
D. 248,334 * 6/1978 Stello ..... D17/8
D. 322,717 * 12/1991 Wyant ..... D3/30.1
416,879 * 12/1889 Warren .
1,509,009 * 9/1924 Weinberg .
1,527,002 * 2/1925 Morgan et al. .

FOREIGN PATENT DOCUMENTS

0404687 * 6/1989 (EP) .

* cited by examiner

*Primary Examiner*—Robert E. Nappi
*Assistant Examiner*—Marlon Fletcher
(74) *Attorney, Agent, or Firm*—Nawrocki, Rooney & Silvertson, P.A.

(57) ABSTRACT

A multi-piece piano cover which can include a lid cover, a rim cover, and a keyboard cover. The cover is adapted to protect a grand piano while the piano is in use and when the piano is not in use. The piano lid can be opened and the keys may be played while the protective cover is in place. The lid cover is adapted to cover the lid upper surface and can be fit to the lid be receiving the lid front in a lid cover pocket portion and by securing the cover to the lid edges using elastic. The rim cover is adapted to drape over the piano rim while the piano lid is either open or closed. The rim cover can be secured to the piano with straps extending across the piano.

7 Claims, 3 Drawing Sheets

GRAND PIANO SECTIONAL CLOTH COVER

FIELD OF THE INVENTION

The present application is related to devices for covering pianos. Specifically, the present invention is related to grand piano covers having multiple pieces such that tuning and playing are enabled while the piano remains covered and protected.

BACKGROUND OF THE INVENTION

Grand pianos, including baby grand pianos, are beautiful instruments which should be kept in the best possible condition, for both functional and aesthetic reasons. Indeed, in some situations, grand pianos are valued as much for their appearance, as for their musical attributes.

To protect pianos, particularly the exposed wood surfaces, piano covers are often used. In the past, piano covers protecting grand pianos have been formed in one piece, covering both the closed lid and the rim. One-piece covers are adequate, until a piano is to be played or tuned. At this time, the cover must be removed to allow raising the lid, raising the fall board, and accessing the keyboard and music rack. The piano is vulnerable to damage when the cover is removed. The piano is most vulnerable to damage when people are nearby, yet is uncovered during this time.

What would be desirable and has not hitherto been provided is a piano cover adapted to protect a grand piano during use.

SUMMARY OF THE INVENTION

The present invention includes a multi-piece piano cover adapted to cover a grand piano, the piano having a lid and a rim portion. One lid cover includes a front pocket portion which receives the piano front lid portion and partially secures the lid cover to the lid. One lid cover includes elastic in the periphery such that the lid cover can be stretched over the lid and secured under the lid by the elastic material. The lid cover can include a strap to secure the lid cover to the lid, with the strap being removably attachable to the lid cover and extending under the lid when in place. The lid cover can be snugly fit to the rim along its entire circumference, or it can be made with a loose flap along the straight ("bass") side of the piano.

One rim cover is adapted to drape over the rim top edge and is at least partially secured by elastic material extending along the periphery of the rim cover. Another rim cover includes vertical stiffening members to hook over the rim top edge. Yet another rim cover includes a seam containing a wire running horizontally along the inside of the rim while in place.

The present invention allows a grand piano to be protected while the paino is not in use and the lid is lowered. The present invention also allows a grand piano to be protected while in use during piano practice, service or tuning. The piano lid can be raised and the keys played while the lid and rim covers are in place. The covers protect the case of the piano from scratches, small nicks, fading, and various other low-impact damage that commonly occur to pianos.

DETAILED DESCRIPTION OF THE PREFERRED EMBODIMENTS

Figure 1:
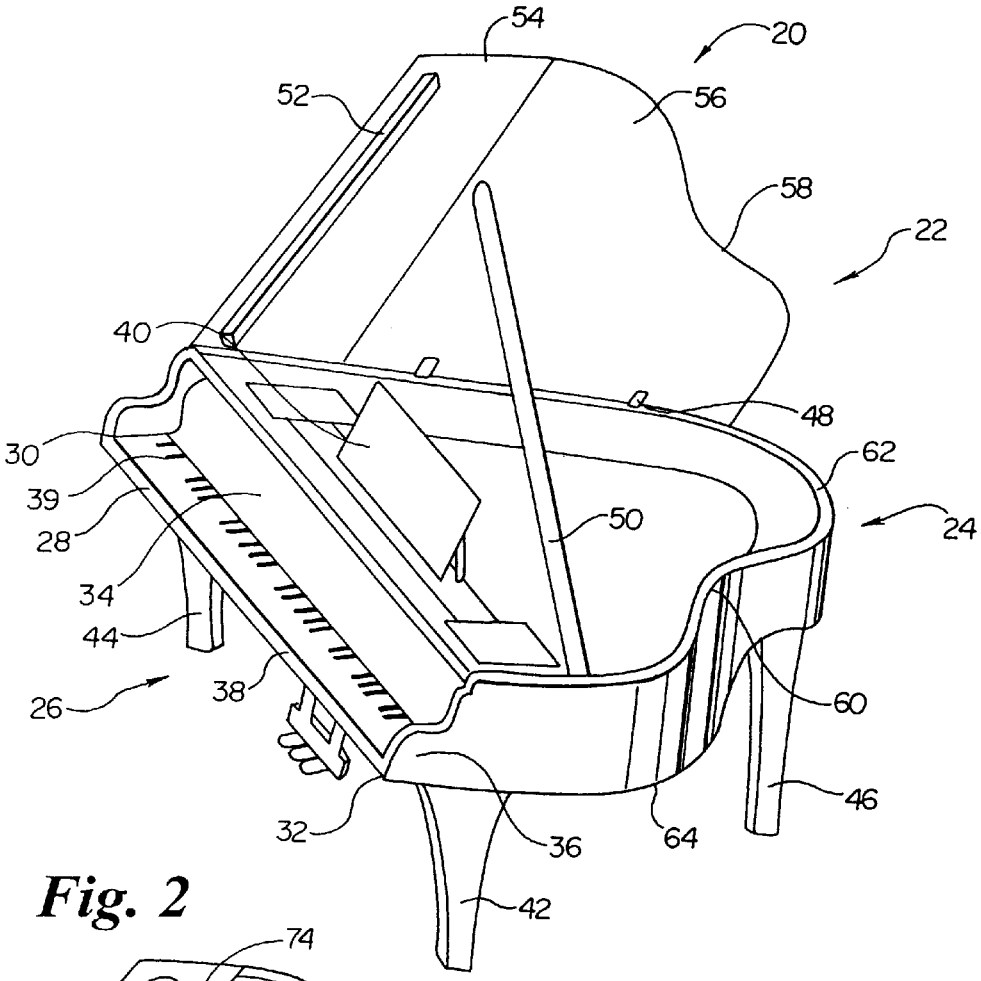
FIG. 1 is a perspective view of a grand piano having a raised lid.

FIG. 1 illustrates a grand piano 20 having generally a lid 22 and a rim 24. Piano 20 includes a front portion 26, a plurality of keys 39, a keybed 38, a fallboard 34, cheeks 36, a keyslip 28, and a music desk 40. Piano front portion 26 has a treble end 32 and a bass end 30. Piano 20 is supported by three legs, a treble leg 42, a bass leg 44, and a rear leg 46. Lid 22 is secured along one side to rim 24 with hinges 48. Lid 22 is supported in an open position with a prop stick 50. Lid 22 is illustrated as having a lock bar 52, a front lid 54, a main lid 56, and a lid edge 58. Rim 24 includes a bend 60, a rim top edge 62, and a rim bottom edge 64.

Figure 2:
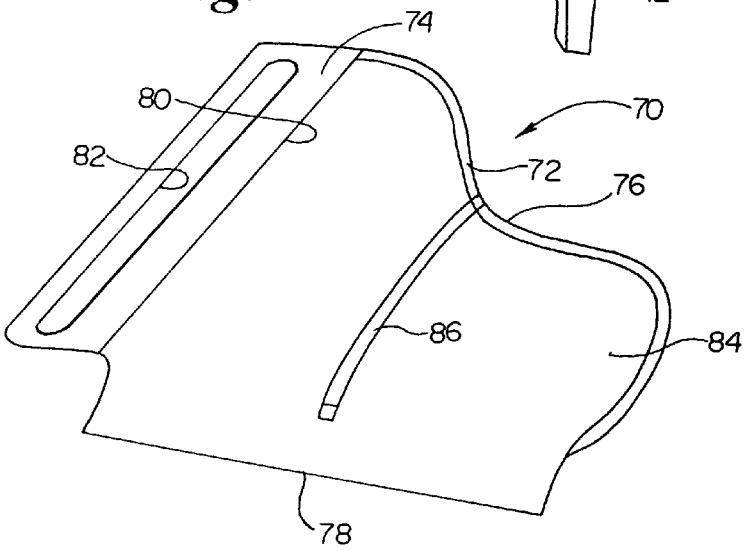
FIG. 2 is a perspective view of a lid cover having a substantially similar orientation to the raised piano lid of FIG. 1, exposing the lid cover underside surface.

Referring now to FIG. 2, a lid cover 70 is illustrated having an edge or waistband portion 72, a bend portion 76, a straight side portion 78, and a pocket or sleeve portion 74. Straight side portion 78 is designed to hang over lid 22 and rim 24 in the region of hinges 48. Lid cover 70 is oriented similarly to lid 22 in FIG. 1. Lid cover 70 is oriented so as to expose a bottom surface 84. Lid cover pocket 74 extends the width of the lid cover and has an opening 80 to receive piano front lid 54 therein. Pocket 74 makes it easy to determine which end of the cover is to go toward the pianist. In the embodiment illustrated, pocket 74 includes a lock bar slit 82 to receive lock bar 52. In one embodiment, lid cover 70 includes elastic material in waistband portion 72 to secure the lid cover to the lid. Lid cover 70 can include a strap 86, from lid cover bend portion 76 to straight portion 78. Strap 86 can run across the underside of lid 56 and between hinges 48. In one embodiment, strap 86 is sewn to lid cover 70 at one end and is removably attachable using hook and loop fasteners, such as VELCRO.

Figure 3:
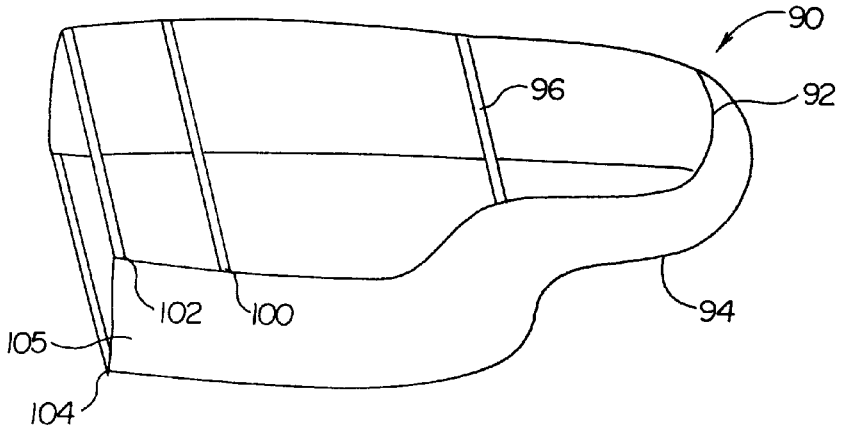
FIG. 3 is a perspective view of a piano rim cover having an open front portion and lateral straps.

Referring now to FIG. 3, a rim cover 90 is illustrated. In the embodiment shown, rim cover 90 includes a top border or edging 92 and a bottom border or edging 94. In a preferred embodiment, top border 92 includes elastic material such that the rim cover material is drawn in and over the rim top edge when in place. In the embodiment shown, rim cover 90 includes a bend strap 96, a music desk strap 100, an upper keyboard strap 102, and a lower keyboard strap 104. The straps can be formed of a cloth, elastic, or plastic material, and can be sewn to rim cover 90 on one end and removably attached with a hook and loop fastener such as VELCRO on the opposite end.

Figure 4:
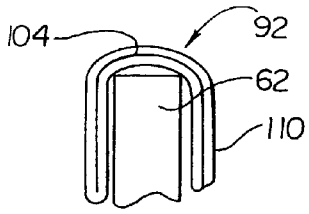
FIG. 4 is a cross-sectional view through a rim top edge and rim cover having a vertical stiffening element therein.
Figure 5:
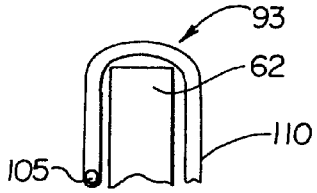
FIG. 5 is a cross-sectional view through a rim top edge and rim cover having a horizontal stiffening element therein.
Figure 6:
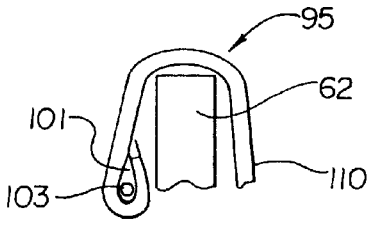
FIG. 6 is a cross-sectional view through a rim top edge and rim cover having a seam and a horizontal elastic member therein.

Referring now to FIG. 4, one embodiment of top border 92 is illustrated, draped over rim top edge 62 and having a stiffening member 104 disposed within a cloth material 110. In one embodiment, stiffening member 104 is malleable and shape retaining and can be formed of wire to hook over rim top edge 62. In another embodiment, stiffening member 104 is rigid and can be formed as an elongate curved rod or thin strip and can be formed from plastic or metal. Stiffening member 104 can act so as to allow rim cover to hang on rim top edge 62. Referring now to FIG. 5, another embodiment top border 93 is illustrated, having a horizontal stiffening member 105. In the preferred embodiment, horizontal stiffening member 105 is formed of a malleable material capable of remembering shape, such as metal wire. Applicant believe stiffening member 105 helps the rim cover to better conform to the piano rim shape of some pianos. Embodiments utilizing stiffening members should be sufficiently cushioned so as not to cause damage to the piano lid or rim when the lid is lowered. Specifically, any hard members such as wires should be adequately padded to avoided making impressions on the wood or finish above and below. Referring now to FIG. 6, yet another embodiment of a top border 95 is illustrated, draped over rim top edge 62 and having an elastic member 103 disposed within a seam 101 in cloth material 110.

Figure 7:
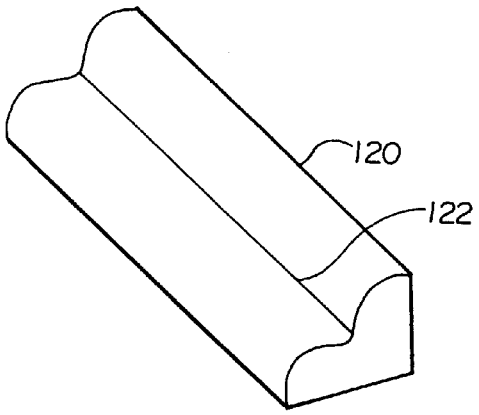
FIG. 7 is a perspective view of a keyboard cover suitable for attaching to the rim cover of FIG. 3.
Figure 8:
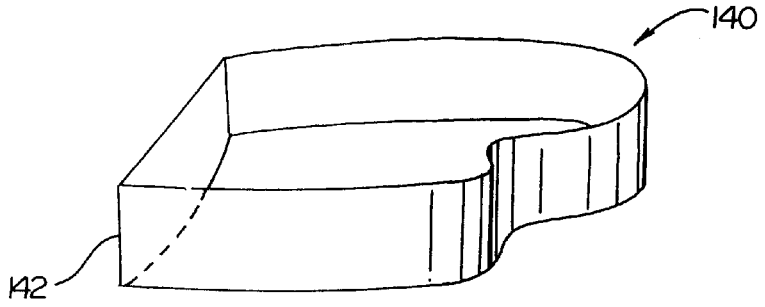
FIG. 8 is a perspective view of an alternate embodiment rim cover having straight front edges.

Referring now to FIG. 7, a keyboard cover 120 is illustrated, having a bend 122 to conform to the bend seen in cheeks 36 in FIG. 1, and to conform to the junction of keys 39 and fallboard 34. In one embodiment, keyboard cover 120 is removably attachable to rim cover 90, at strap 102 or at a rim cover side portion as indicated at 105. In the embodiment illustrated in FIG. 9, rim cover side portion 105 is adapted to wrap around and cover cheeks 36. In another embodiment, illustrated in FIG. 8, a rim cover 140 is illustrated having front side edges 142 that stop short of covering cheeks 36.

Figure 9:
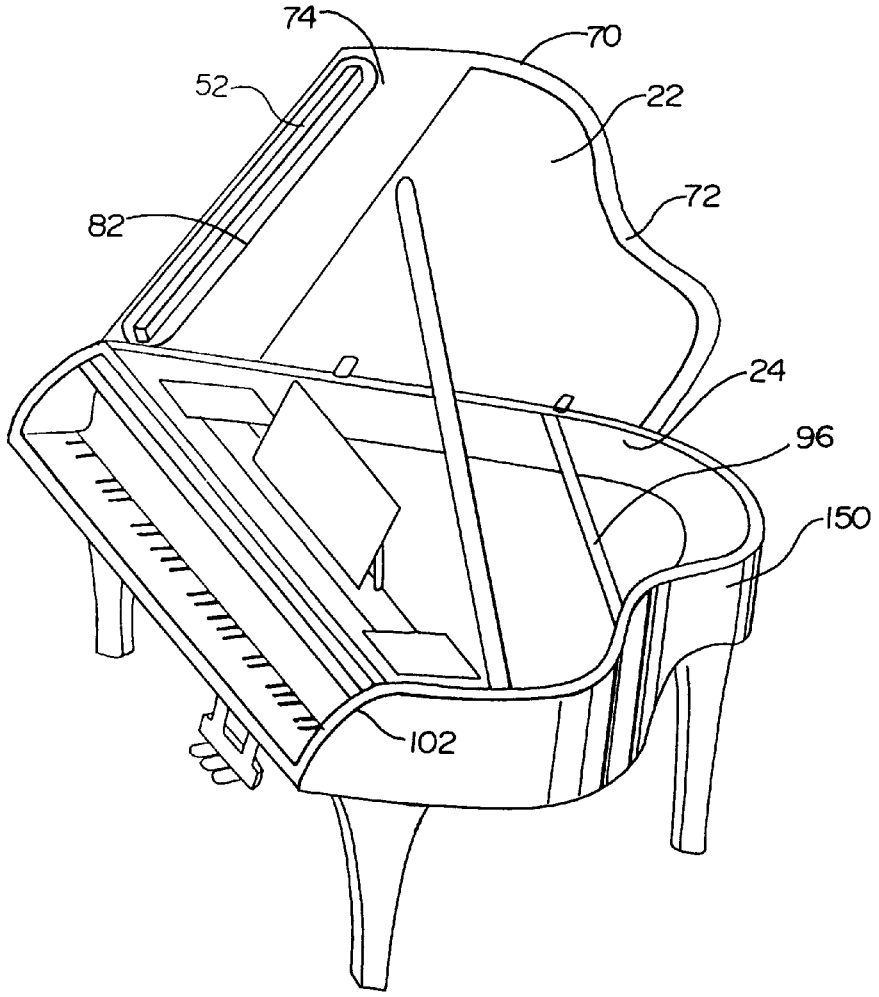
FIG. 9 is a perspective view of the piano of FIG. 1 having a lid cover protecting the lid and a rim cover protecting the rim.

Referring now to FIG. 9, lid cover 70 is illustrated in place over lid 22, having front lid portion 54 inserted into pocket 74 and lock bar 52 protruding through lock bar slit 82. Lid cover waistband 72 is shown covering the lid edge 58 (not visible in FIG. 9). A rim cover 150, similar to rim cover 90, is illustrated in place over rim 24. Rim cover 150 includes bend strap 96, keyboard upper strap 102, and keyboard lower strap 104 (not visible in FIG. 9).

Lid cover 70, rim cover 90, and keyboard cover 120 are preferably formed of a cloth material, such as wool flannel. Other materials may be used, such as quilted materials for added protection. One embodiment is formed from the loop material used in hook and loop fasteners.

A piano can be protected both when in use and when not in use. When in use, lid 22 can be propped open with prop stick 50, leaving both lid 22 and rim 24 protected. When not is use, lid 22 can be lowered, leaving both rim and lid still protected. In this way, the piano remains protected when in use, when protection is often most needed.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The inventions's scope is, of course, defined in the language in which the appended claims are expressed.

What is claimed is:

1. A cover adapted to protect a grand piano having a lid, wherein said grand piano lid has a circumferential edge, an upper surface, a lower surface, and a front portion having a lock bar positioned on the lower surface, said lower surface having a margin portion interior of said edge, comprising:

a flexible lid cover having an elastic portion covering at least a portion of said lower surface margin portion, such that said lid cover is at least partially secured to said lid by said cover elastic portion, said lid cover further including a pocket which receives said lid front portion.

2. A piano lid cover as recited in claim 1 wherein said lid has a treble side and a bass side and said cover has a strap extending from said treble side to said bass side, such said cover can be at least partially secured to said lid by securing said strap along said lid bottom surface.

3. A multi-piece cover which protects a grand piano lid and a rim, comprising:

a lid cover; and a rim cover;

said lid cover and said rim cover being sized and shaped to cover the piano lid and rim, respectively, without obstructing access to a keyboard of the grand piano so that the grand piano can be played when said lid cover and said rim cover are in place covering said grand piano lid and rim, respectively.

4. A multi-piece piano cover as recited in claim 3 further comprising a keyboard cover, said keyboard cover including means for attaching to said rim cover.

5. A multi-piece piano cover as recited in claim 3 wherein said lid cover includes means for securing said lid cover to said lid.

6. A multi-piece piano cover as recited in claim 5 wherein said lid includes a front portion and said means for securing said lid cover to said lid includes a pocket for receiving said lid front portion.

7. A multi-piece piano cover as recited in claim 6 wherein said rim cover includes means for securing said rim cover to said rim.

* * * * *